US005138231A

United States Patent [19]

Iida et al.

[11] Patent Number: 5,138,231

[45] Date of Patent: Aug. 11, 1992

[54] HIGH PRESSURE METAL VAPOR DISCHARGE LAMP

[75] Inventors: Takenobu Iida; Shunichi Sasaki, both of Saitama, Japan

[73] Assignee: Iwasaki Electric Co., Ltd., Tokyo, Japan

[21] Appl. No.: 679,492

[22] Filed: Apr. 2, 1991

[30] Foreign Application Priority Data

Apr. 2, 1990 [JP] Japan ..... 2-87872
Apr. 2, 1990 [JP] Japan ..... 2-87873

[51] Int. Cl.[5] ..... H01J 7/44; H05B 37/00; H05B 41/14

[52] U.S. Cl. ..... 315/73; 315/59; 315/240; 315/290; 315/243

[58] Field of Search ..... 315/58, 59, 73, 232, 315/240, 241 R, 243, 289, 290

[56] References Cited

U.S. PATENT DOCUMENTS 4,277,725 7/1981 Sneiger ..... 315/73
4,447,759 8/1984 Moerkens et al. ..... 315/60
4,742,275 5/1988 Ito et al. ..... 315/104
4,807,085 2/1989 Yasukawa et al. ..... 361/321
4,897,576 1/1990 Iida et al. ..... 315/73
4,910,437 3/1990 Daniels ..... 315/208
4,959,593 9/1990 Joanino ..... 315/290

FOREIGN PATENT DOCUMENTS 0181666 5/1986 European Pat. Off. .
3148821 7/1982 Fed. Rep. of Germany .
3536385 4/1986 Fed. Rep. of Germany .
565815 2/1981 Japan .
2035678 6/1980 United Kingdom .

*Primary Examiner*—Eugene R. Laroche
*Assistant Examiner*—Michael B. Shingleton
*Attorney, Agent, or Firm*—Sughrue, Mion, Zinn, Macpeak & Seas

[57] ABSTRACT

A high-pressure metal vapor discharge lamp comprises: an arc tube, which is shunted by a series circuit of a thermal switch and a nonlinear ceramic capacitor, a pyroelectric current bypassing resistor connected in parallel to the nonlinear ceramic capacitor, and a lamp outer bulb incorporating the arc tube, the thermal switch, the nonlinear ceramic capacitor and the resistor. Because of this construction, the nonlinear ceramic capacitor is prevented from early deterioration, thus lengthening the service life of the discharge lamp.

7 Claims, 11 Drawing Sheets

HIGH PRESSURE METAL VAPOR DISCHARGE LAMP

BACKGROUND OF THE INVENTION

This invention relates to a high pressure metal vapor discharge lamp, and more particularly to a starter circuit for the discharge lamp.

In order to start a high pressure metal vapor discharge lamp such as a high pressure sodium lamp, it is necessary to apply a high discharge start voltage to the lamp. For this purpose, a variety of discharge lamp starting units have been proposed in the art.

One example of a conventional discharge lamp starting unit will be described with reference to FIG. 1.

As shown in FIG. 1, a power source 10 is connected in series to an arc tube 12, which is shunted by a series circuit of a thermal switch 14 and a non-linear ceramic capacitor or a ferro electric capacitor 16 (hereinafter referred to as "an FEC 16"). The arc tube 12, the thermal switch 14, and the FEC 16 are built in a bulb 20. The thermal switch 14 is kept closed at room temperature; that is, it is opened when the ambient temperature increases to a predetermined value.

In turning on the lamp, power is supplied to the FEC 16 through the thermal switch 14 which is closed at room temperature, so that the FEC 16 is charged; that is, the latter FEC 16 produces a pulse voltage which induces discharges in the arc tube 12.

As a result, the arc tubes 12 turns on, to increase the ambient temperature. Hence, the thermal switch is opened (or turned off), and accordingly, the generation of the pulse voltage by the FEC 16 is ceased to disconnect a load applied to the FEC 16.

A second example of the conventional discharge lamp starting unit is as shown in FIG. 2. As is apparent from comparison of FIGS. 1 and 2, the discharge lamp starting unit shown in FIG. 2 can be obtained by connecting a semiconductor switch 18 in series to the series circuit of the thermal switch 14 and the FEC 16 in the first example of the conventional discharge lamp starting unit shown in FIG. 1. With the semiconductor switch 18 connected to the series circuit, the pulse voltage generated by the FEC 16 can be used for starting the discharge lamp 12 more effectively.

A third example of the conventional discharge lamp starting unit is as shown in FIG. 3. In the third example, a power source 10 is connected through a ballast 19 to an arc tube 12 (comprising a polycrystalline alumina tube), which is shunted by a series circuit of a thermal switch 14 such as a bimetal switch and an FEC 16. The thermal switch is held closed at room temperature; that is, it is opened when the ambient temperature increases to a certain value.

The discharge lamp starting unit further comprises a start assisting conductor 48 which is extended from the connecting point of the thermal switch 14 and the FEC 16 substantially over the whole length of the arc tube 12 and held in contact with the outer surface of the arc tube 12. That is, the conductor 48 has one end 48*a* which is a free end, and the other end 48*b* which is connected to the connecting point of the thermal switch 14 and the FEC 16. Those elements 12, 14, 16 and 48 are built in an outer bulb 20.

In order to turn on the lamp, current is drawn from the power source 10 through the thermal switch 14, which is closed at room temperature, to the FEC 16 to charge the latter 16. As a result, the FEC 16 generates a high pulse voltage. The high pulse voltage together with the supply voltage is applied to the arc tube 12 to induce discharges in the latter 12.

As a result, the arc tube 12 is turned on, and the ambient temperatures is increased, so that the thermal switch 14 is turned off, whereby the oscillation of the FEC 16 is ceased. Thus, the lamp is kept turned on in the ordinary manner.

The start assisting conductor 48 laid over the arc tube 12 is used to apply electric field to the inside of the arc tube to decrease the starting voltage, thereby to enhance the induction of discharges in the arc tube 12 at the start of the lamp.

FIG. 4 shows a fourth example of the conventional discharge lamp starting unit. The fourth example of the conventional discharge lamp starting unit can be obtained by modifying the above-described third example (FIG. 3) as follows: The thermal switch 14 is removed from the third example (FIG. 3), and instead thermal switches 14*a* and 14*b* are connected to both ends of the start assisting conductor 48 as shown in FIG. 4. The start assisting conductor 48 is electrically disconnected from the circuit after the lamp has started. The thermal switch 14*a* connected to one end of the start assisting conductor 48 is connected in series to the power source 10 through the ballast 19. The thermal switch 14*b* connected to the other end of the start assisting conductor 48 is connected to the FEC 16, and it is closed at room temperature. Therefore, when the lamp is kept turned on, the ambient temperature is increased, whereby the thermal switches 14*a* and 14*b* are turned off. As a result, the start assisting conductor 48 is electrically disconnected from the circuit. The fourth example of the conventional discharge lamp starting unit further comprise a semiconductor switch 18 which is connected in series to the FEC 16 which is connected to the thermal switch 14*b* as was described above; and a resistor 24 which is connected in parallel to the semiconductor switch 18. The resistor 24 is used to stabilize the switching phase.

The above-mentioned examples of the conventional discharge lamp starting unit shown in FIGS. 1 through 4 are disadvantageous in the following points:

The FEC 16 is a ferro-electric ceramic capacitor, which shows ferro-electricity at temperatures lower than the Curie temperature and paraelectricity at temperatures higher.

When the lamp is started, the FEC 16 is at room temperature lower than the Curie temperature. Therefore, the FEC 16 shows ferro-electricity, thus being able to generate the pulse voltage; however, it should be noted that, with the voltage, the FEC 16 is subjected to poling.

FIG. 5 shows the dielectric constant characteristic of the FEC. As is apparent from FIG. 5, the FEC is a ferro-electric element at temperatures lower than the Curie temperature (about 90° C.), the FEC, being a ferro-electric element, is subjected to poling with the pulse voltage generated when the lamp is started.

On the other hand, while the lamp is kept stably operated, the FEC 16 is held at temperatures higher than the Curie temperature by the heat of the arc tube 12, thus becoming a paraelectric element.

When the ferro-electric element subjected to poling once is changed into a paraelectric element (by the raise of temperature in this case), depoling occurs. The current flowing in this case is called "pyroelectric current". The pyroelectric current becomes maximum at a temperature slightly lower than the Curie temperature, and that the FEC is therefore subjected to depoling (cf. Ceramic Engineering for Dielectrics, page 13, by Kiyoshi Okazaki, published by Gakkensha).

When, in each of the circuits shown in FIGS. 1 through 4, the lamp is stably operated, and the thermal switch 14 is turned off at a temperature lower than the Curie temperature of the FEC 16 (which is 90° C. as is seen from FIG. 5), the depoling is carried out through the ceramic grain boundaries of the FEC 16, or by the surface discharge (corona discharge) between the two electrodes of the FEC 16.

Thus, whenever the lamp is turned on and off, the process of poling and depoling is carried out. In the case of a high- pressure metal vapor discharge lamp, the outer bulb is highly evacuated, and therefore the depoling through the grain boundary is great, the resistance of the grain boundaries is decreased, and tan $\delta$ is increased. Thus, in FIG. 6, the end portion Q closing the hysteresis characteristic curve of poling (P) and electric field (E) is gradually widened; that is, the hysteresis transition becomes dull. As a result, the switching characteristic of the FEC 16 is lowered, and the pulse voltage is decreased. Under this condition, finally the starting of the lamp is impossible, and the service life of the lamp may be shortened.

Further, in each of the conventional discharge lamp starting units shown in FIGS. 3 and 4, while the arc tube 12 is being operated, the start assisting conductor 48 is held in contact with the arc tube 12, whereby the wall of the arc tube 12 is partially increased in temperature; that is, the wall of the arc tube 12 becomes non-uniform in temperature distribution, which may crack the wall of the arc tube 12. Furthermore, since surface leaked voltage is applied to the start assisting conductor 48, the sodium in the arc tube 12 may leak through the wall of the arc tube 12.

In the case of the conventional discharge lamp starting unit shown in FIG. 3, while the lamp is operated, some voltage is applied through the FEC 16 to the arc tube 12. Therefore, with a discharge lamp in high operating temperature, the loss of sodium is increased. Accordingly, the starting unit is not applicable to high-power discharge lamps as operating on higher temperature of the arc tube. On the other hand, as the wall of the arc tube 12 is increased in temperature, the insulating resistance of the wall is decreased, so that the arc discharge column in the arc tube 12 is electrically connected to the FEC 16 as if there were a resistor between them. As a result, a high voltage is applied to the FEC 16, so that migration occurs with the silver of the metallized film electrode, whereby the pulse voltage is decreased, and the FEC 16 itself may be deteriorated soon.

In case of the conventional discharge lamp starting unit shown in FIG. 4, although the start assisting conductor 48 is disconnected from the circuit, the arc potential in the arc tube 12 is applied through the arc tube wall to the start assisting conductor 48. Therefore, the discharge lamp starting unit also causes the loss of sodium. In addition, the thermal switches 14*a* and 14*b* connected to both ends of the star assisting conductor 48 are not practical in use. That is, in each of the thermal switches, the contact pressure is difficult to adjust. And in the case of a discharge lamp with a small outer bulb, it is rather difficult to install the thermal switch therein, because the outer bulb is not large enough in space.

In order to eliminate these difficulties, the following discharge lamp starting unit has been proposed: That is, in the discharge lamp starting unit as shown in FIG. 3 or 4, a thermally operating piece such as a bimetal element is connected to at least one end of the start assisting conductor, and the free end of the thermal operating piece is fixedly welded to a post. The contact pressure of the thermally operating piece is so adjusted that, while the lamp is operated, the start assisting conductor is moved away from the wall of the arc tube by the heat produced thereby (Japanese Utility Model Application Examined Publication No. Sho. 56–5815).

The start assisting conductor construction as described above is advantageous in that the leakage of the sodium in the arc tube is prevented, and the wall of the outer bulb is scarcely cracked. However, the unit is still disadvantageous in the following points: It is true that the start assisting conductor is held away from the arc tube by means of the thermally operating piece while the lamp is operated; however, when the lamp is started again, after power is interupted for a few seconds and the lamp is turned off, which calls "restart", sometimes the start assisting conductor is brought into contact with the outer wall of the arc tube after the FEC generates the pulse voltage. That is, in this case, the FEC generates the pulse voltage under the condition that the start assisting conductor does not work and the lamp does not light up. Therefore, unavoidably the FEC is deteriorated earlier. On the other hand, the case may be considered in which the start assisting conductor is brought into contact with the outer wall of the arc tube before the FEC generates the pulse voltage. In this case, in order to obtain the pulse voltage which positively starts the discharge lamp or restarts it, the FEC must be at a temperature lower than its Curie point.

SUMMARY OF THE INVENTION

In view of the foregoing, an object of this invention is to eliminate the above-described difficulties accompanying a conventional high-pressure metal vapor discharge lamp.

More specifically, an object of the invention is to provide a high-pressure metal vapor discharge lamp which is sufficiently long in service life being free from the difficulty that its FEC is deteriorated earlier by the pyroelectric current which is allowed to flow during depoling after it is poled.

Another object of the invention is to provide a high-pressure metal vapor discharge lamp in which, while the lamp is being operated stably, its start assisting conductor is positively set away from the arc tube whereby the arc tube is prevented from the loss of sodium and from being cracked, and in which, the start assisting conductor surely touches the wall of the arc tube at restart before the FEC starting unit is energized and the starting pulses generated from its unit works on restarting the lamp more effectively, the FEC is allowed to operate at a temperature lower than its Curie point, whereby the lamp can be positively started, and started again.

In order to achieve the foregoing objects and other objects, the invention provides:

a high-pressure metal vapor discharge lamp which, according to a first aspect of the invention, comprises: an arc tube which is connected to a power source; a lamp starting circuit including a series circuit of a thermal switch a non-linear ceramic capacitor, the series circuit being connected in parallel to the arc tube, and a pyroelectric current bypassing resistor connected in parallel to the non-linear ceramic capacitor; and a lamp outer bulb incorporating the arc tube and the lamp starting circuit, and a high-pressure metal vapor discharge lamp in which an arc tube is connected in parallel to a series circuit of a starter including a non-linear ceramic capacitor and a thermal switch through which the starter is connected to a power source, and a start assisting conductor is provided in such a manner that the start assisting conductor is brought into close contact with and moved away from the tube wall of the arc tube by means of a thermally operating piece; in which, according to a second aspect of the invention, the thermal switch is operated at temperatures lower than the Curie point of the non-linear ceramic capacitor, and the thermally operating piece operates to bring the start assisting conductor into close contact with the arc tube before the thermal switch is turned on, at restart.

In the first of the discharge lamps thus constructed, the pyroelectric current bypassing resistor connected in parallel to the nonlinear ceramic capacitor acts to bypass the pyroelectric current allowed to flow by depoling after the nonlinear ceramic capacitor is poled, which is caused when the lamp is turned on and off, so that the switching characteristic of the nonlinear ceramic capacitor is maintained satisfactorily, thus lengthening the service life of the discharge lamp.

In the second discharge lamp, while the latter is being lighted the thermally operating piece sets the start assisting conductor away from the arc tube, whereby the difficulty is positively eliminated that the arc tube suffers from the loss of sodium, or its wall is cracked. The nonlinear ceramic capacitor forming a starter operates at a temperature lower than the Curie point, and at restart the start assisting conductor is brought into close contact with the arc tube by the thermally operating piece before the thermal switch adapted to connect the starter to the power source is turned on, whereby the nonlinear ceramic capacitor can generate the pulse voltage with high efficiency, thus positively restarting the lamp.

The nature, principle and utility of the invention will become more apparent from the following detailed description when read in conjunction with the accompanying drawings, in which like parts are designated by like reference numerals or characters.

DETAILED DESCRIPTION OF THE PREFERRED EMBODIMENTS

Figure 1:
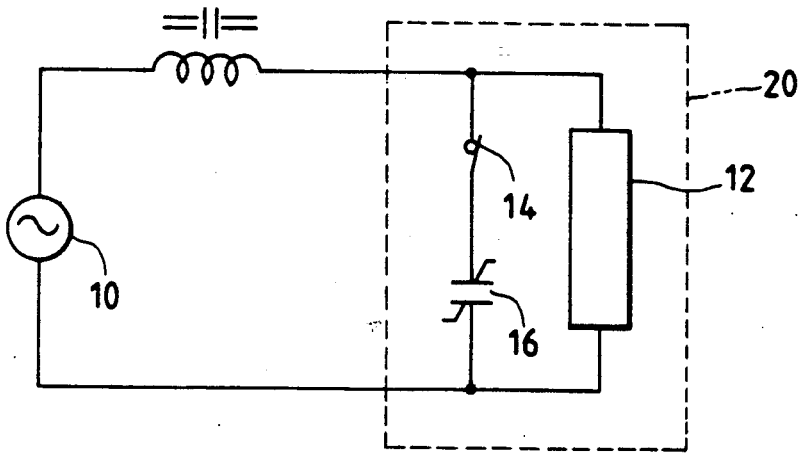
FIG. 1 PRIOR ART
FIGS. 1 through 4 are circuit diagrams showing first through fourth examples of a conventional high-pressure metal vapor discharge lamp, respectively.
Figure 2:
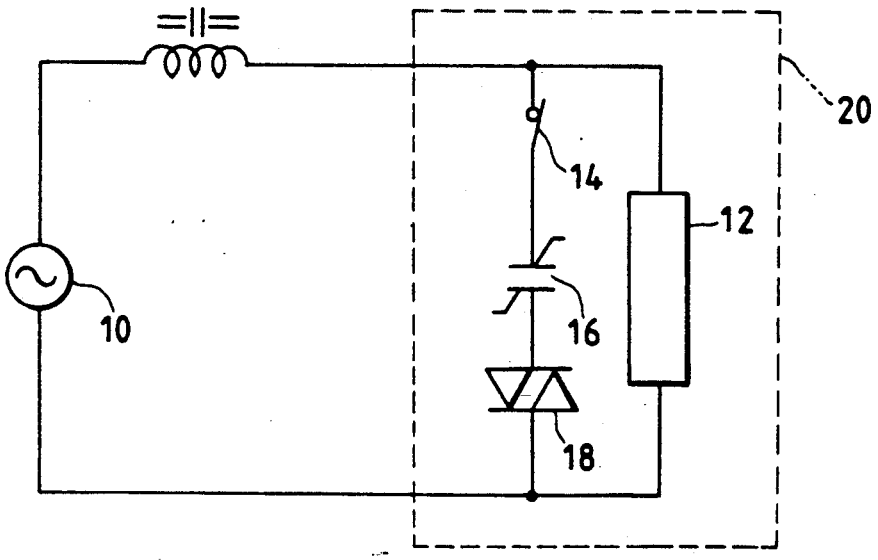
FIG. 2 PRIOR ART
Figure 3:
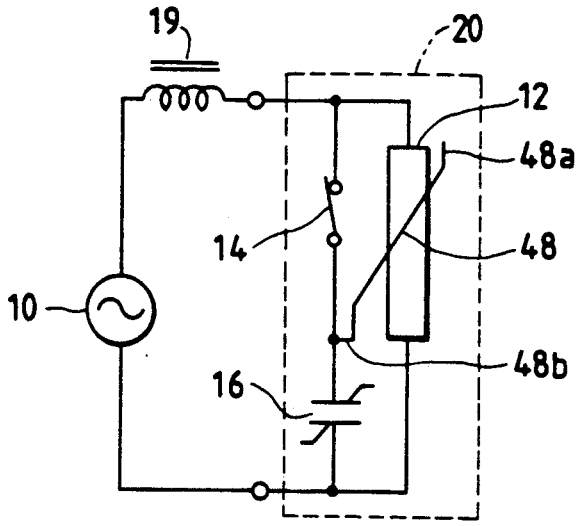
FIG. 3 PRIOR ART
Figure 4:
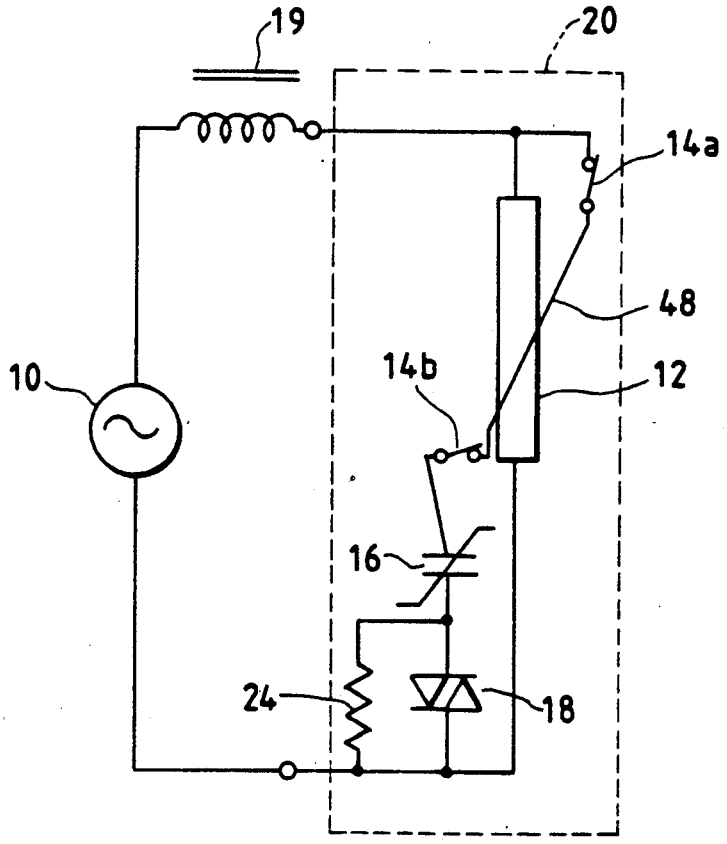
FIG. 4 PRIOR ART

Preferred embodiments of this invention will be described with reference to the accompanying drawings, in which parts corresponding functionally to those which have been described with reference to FIGS. 1 through 4 are therefore designated by the same reference numerals or characters.

Figure 7:
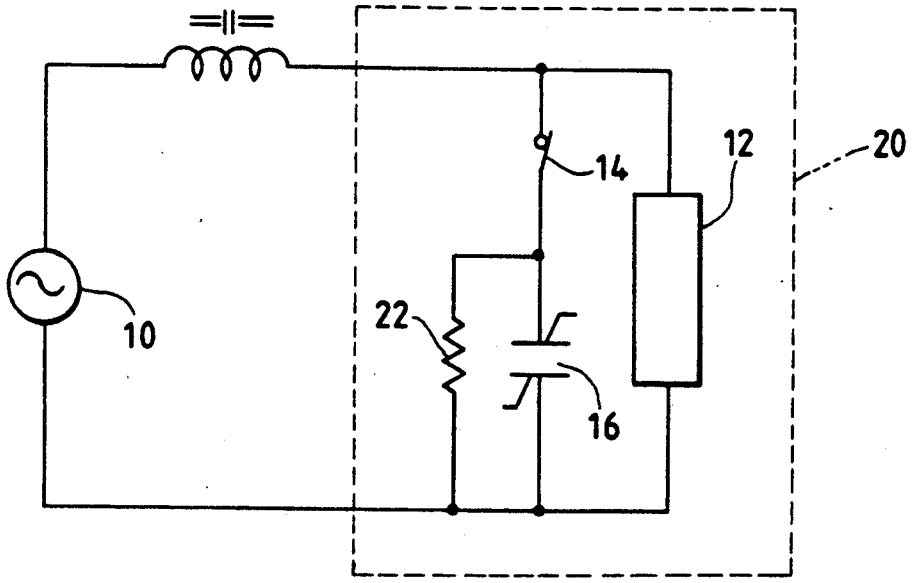
FIG. 7 is a circuit diagram showing a first example of a high-pressure metal vapor discharge lamp according to this invention.

FIG. 7 shows an example of a high-pressure metal vapor discharge lamp according to the invention which constitutes a first embodiment of the invention.

The high-pressure metal vapor discharge lamp comprises: an arc tube 12 shunted by a series circuit of a thermal switch 14 and an FEC 16; a pyroelectric current bypassing resistor 22 which is connected in parallel to the FEC 16. Those elements 12, 14, 16 and 22 are built in an outer bulb 20.

In the embodiment, in order to form the FEC 16, a substrate 15.5 mm in diameter and 0.65 mm in thickness containing barium titanate essentially is formed as follows: Of the barium titanate ($BaTiO_3$), the barium (Ba) is replaced with strontium (Sr), part of the titanium (Ti) is replaced by zirconium (Zr) and hafnium (Hf). To the powder thus obtained is added mineralizers of manganese (Mn) and chromium (Cr). The powder thus produced is pressed and sintered to form the aforementioned substrate. A sliver layer 14.5 mm in diameter is formed on each of the two sides of the substrate by metallizing. The sliver layers are coated with glass so as to be served as electrodes with lead terminals (cf. U.S. Pat. Ser. No. 4,807,085).

The arc tube 12 is a 110W high-pressure sodium lamp for instance.

The thermal switch 14 is so designed as to change state at about 60° C. for the following reason: When, while the lamp is being operated, with the Curie temperature exceeded, an electric field is applied to the FEC 16, the latter is increased in loss (tan δ), as a result of which the FEC 16 is deteriorated and the generated pulse is lowered so that the discharge lamp may not be satisfactorily started.

In starting the discharge lamp, the thermal switch 14 is in "on" state, and therefore the power is applied to the FEC 16, so that the latter 16 generates a pulse voltage and is poled. And, after the FEC 16 is subjected to poling, the ambient temperature reaches about 60° C., the thermal switch 14 is turned off, as was described before. As the temperature is further increased, the pyroelectric current is allowed to flow through the pyroelectric current bypassing resistor 22, so that the FEC 16 is completely subjected to depoling. That is, the energy charged in the FEC 16 immediately before the thermal switch 14 is turned off is discharged throught the resistor 22.

Now, the resistance value of the pyroelectric current bypassing resistor 22 will be described.

Figure 8:
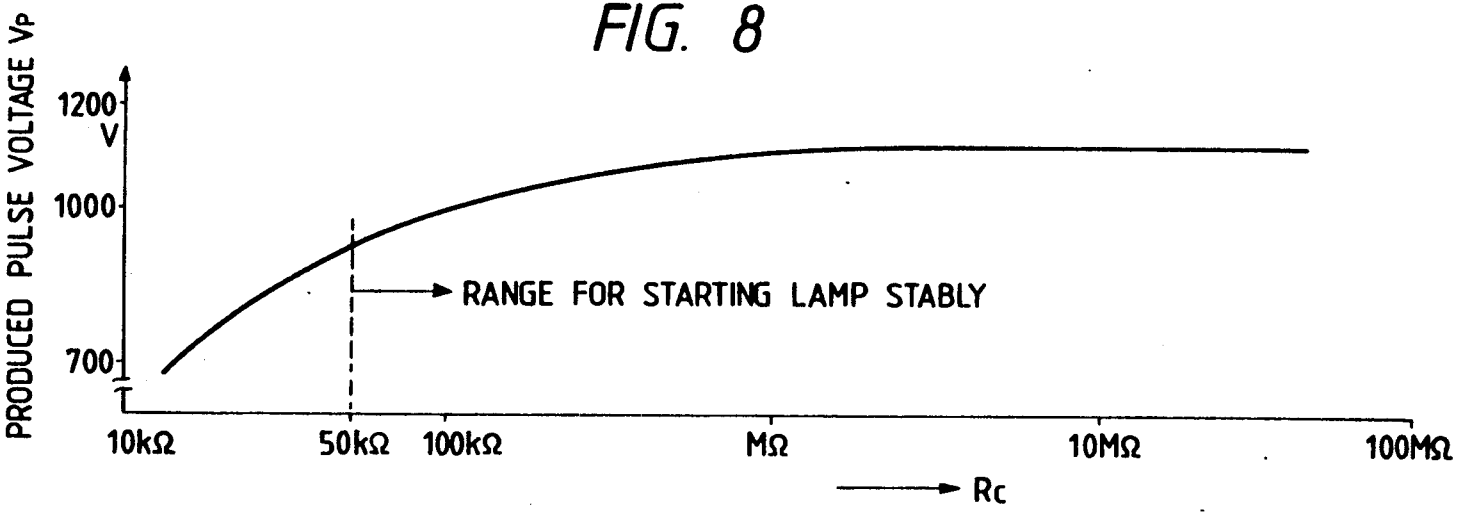
FIG. 8 is a graphical representation indicating the pulse voltages which an FEC generates with the resistance of a pyroelectric current bypassing resistor varied.

FIG. 8 shows the pulse voltages which an FEC (14.5 mm in metallized diameter, and 0.65 mm in thickness) generates in conjunction with the resistance of the pyroelectric current bypassing resistor 22 varied. In this measurement, a ballast 125 W, 50 Hz, for mercury lamps according to the IEC standard was employed, and a supply voltage of 220 V. Under this condition, in order to stably operate the lamp, it is necessary that the pulse voltage thus generated is at least 550 V. That is, as is apparent from FIG. 8, the resistance of the bypass resistor 22 should be at least 50 KΩ.

Figure 9:
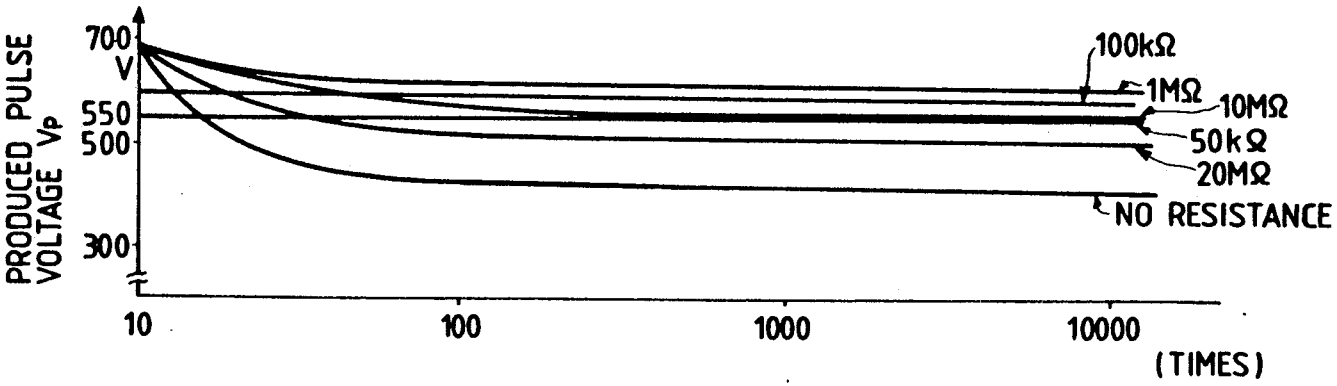
FIG. 9 is also a graphical representation showing generated pulse voltages with switching on/off cycles in the case where the resistance of the pyroelectric current bypassing resistor is varied.
Figure 10:
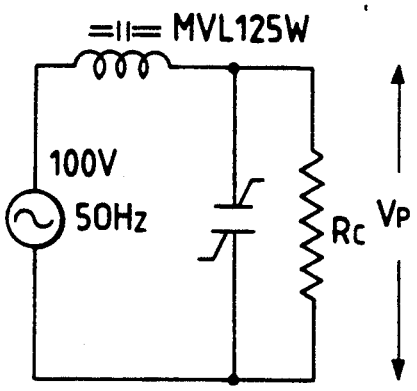
FIG. 10 is a diagram showing an experimental circuit used for obtaining the data shown in FIG. 9.

FIG. 9 shows produced pulse voltages with lighting on/off cycles in the case where the resistance of the pyroelectric current bypassing resistor 22 is varied. In this measurement, the lamp employed was a 110 W high-pressure sodium lamp for a 125 W mercury lamp ballast. The lamp was used together with the ballast similarly as in the measurement shown in FIG. 8. And in order to the prevent the mixing of noises with the data, measurement of the pulse voltages was carried out under condition of non-ignited lamp. More specifically, a circuit as shown in FIG. 10 was used to measure the pulse voltages with a supply voltage of 100 V. In the circuit, an AC source (100 V, 50 Hz) is connected through a choke coil (MVL 125 W) to a parallel circuit of an FEC and a pyroelectric current bypassing resistor (Rc), so that a pulse voltage Vp is measured across the between-resistor (Rc).

In this case, in order to stably light the lamp, it is necessary that the generated pulse voltage Vp is at least 550 volts. Hence, as is seen from FIG. 8, the resistance should be in a range of from 50 KΩ to 10 MΩ.

On the other hand, it is desirable that the resistance of the pyroelectric current bypassing resistor 22 is lower than 1/1000 of the resistivity of the FEC 16. If the resistance is higher than that value, the degree of depoling by the grain boundaries is increased, so that the FEC 16 is greatly deteriorated. As the resistance of the resistor 22 decreases, the pyroelectric current is allowed to flow through it readily, and therefore deterioration of the FEC 16 is lessened as much. However, since the resistor serves as a shut resistor for the generated pulse voltage, the latter is decreased.

Thus, in view of the characteristics shown in FIGS. 8 and 9 and the lamp starting voltage, the resistance of the pyroelectric current bypassing resistor 22 should be in a range of from 50 KΩ to 10 MΩ.

When subjected to poling and afterwards depoling, the FEC 16 is discharged through the resistor 22 which is much lower in resistance than the FEC's ceramic grain boundaries, which prevents the deterioration of the FEC.

A test was given to the above-described discharge lamp starting circuit which, in this case, included a pyroelectric current bypassing resistor of 1 MΩ and a 125 W mercury lamp ballast. With the circuit thus formed, an operation of turning on the lamp for one hour and turning it off for one hour was carried out 10,000 times; however, the FEC 16 was not deteriorated at all.

In the above-described embodiment, a semiconductor switch may be connected in series to the FEC 16. In this modification, the pulse voltage produced by the FEC 16 can be more efficiently utilized.

Figure 11:
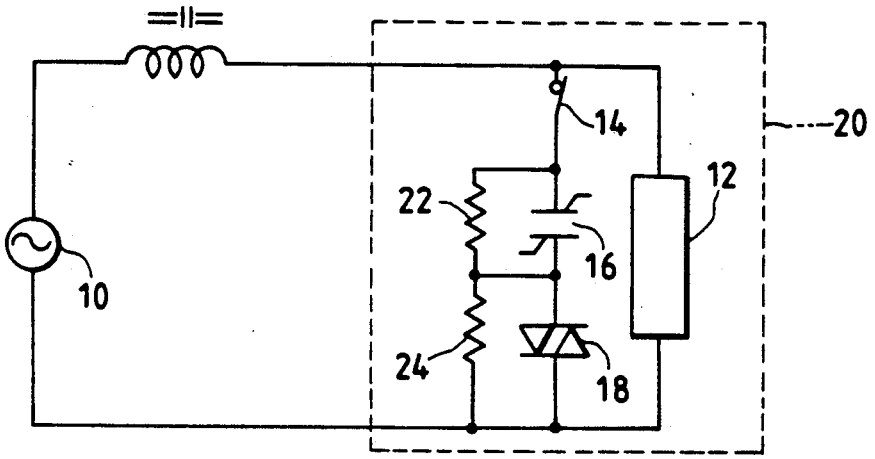
FIGS. 11 and 12 are circuit diagrams showing second and third examples of the high-pressure metal vapor discharge lamp according to the invention, respectively.

FIG. 11 shows another example of the high-pressure metal vapor discharge lamp which constitutes of a second embodiment of the invention. The circuit comprises: a series circuit of a thermal switch 14 and an FEC 16; a semiconductor switch 18 connected in series to the series circuit; a pyroelectric current bypassing resistor 22 connected in parallel to the FEC 16; and a resistor 24 connected in parallel to the semiconductor switch 18.

The pyroelectric current bypassing resistor 22 has the same function as the one in the first embodiment. The resistor 24 is to stabilize the phase in break-over of the semiconductor switch 18.

The circuit shown in FIG. 11 was formed for test. In the circuit, the lamp was a 360 W high-pressure sodium lamp, the pyroelectric current bypassing resistor 22 was 1 MΩ, the resistor 24 was 100 KΩ, the FEC 16 was the same as the one in the first embodiment (FIG. 7), and the semiconductor switch 18 was of 220 V break-over voltage. Those elements 12, 14, 16, 18, 22 and 24 were built in an outer bulb 20, and the semiconductor switch 18 was arranged inside the base of the bulb 20. Furthermore, a 400 W mercury lamp ballast was employed.

With the circuit thus formed, an operation of turning on the lamp for one hour and turning it off for one hour was carried out 10,000 times, with the result that the FEC 16 was not deteriorated at all.

Figure 12:
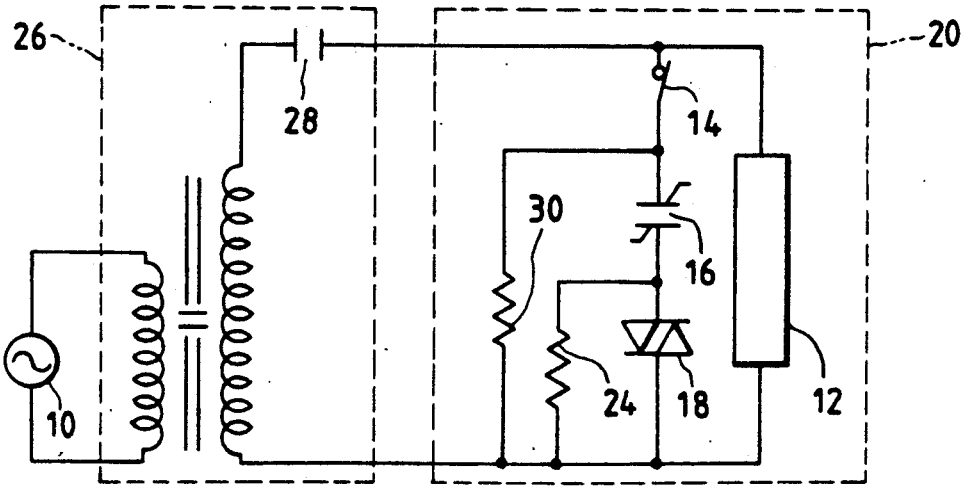

FIG. 12 shows another example of the high-pressure metal vapor discharge lamp which constitutes a third embodiment of the invention.

The circuit, as shown in FIG. 12, comprises: a resistor 30 which acts in the same manner as the pyroelectric current bypassing resistor in the first embodiment (FIG. 7) and functions as a discharge resistor for a capacitor 28 connected in series to a phase advance type ballast 26. The resistor 30 is connected in parallel to a series circuit of an FEC 16 and a semiconductor switch 18.

In general, it is required that the resistance of the resistor 30 is lower than the sum of the resistance of the resistor 22 and that of the resistor 24 in the second embodiment (FIG. 11). This is to quickly discharge the phase-advancing capacitor 28 to achieve the restoration of the starter in a short period of time, thereby to supply as many pulse voltages as possible thereby to start the lamp with ease (when the capacitor 28 is charged, the charge voltage exceeding the saturation voltage Es of the FEC 16, becomes a bias voltage for the latter 16, thus ceasing the switching of the FEC 16).

In the above-described embodiments, the high-pressure sodium lamp is employed: however, the invention is not limited thereto or thereby. That is, metal halide lamps, low-temperature mercury lamps and other HID lamps may be employed.

Figure 13:
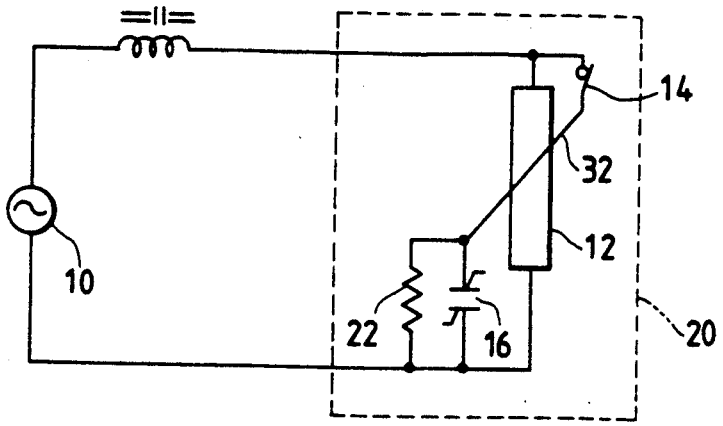
FIGS. 13 and 14 are circuit diagrams showing modifications of the first and second examples of the high-pressure metal vapor discharge lamp starting circuit according to the invention, respectively.
Figure 14:
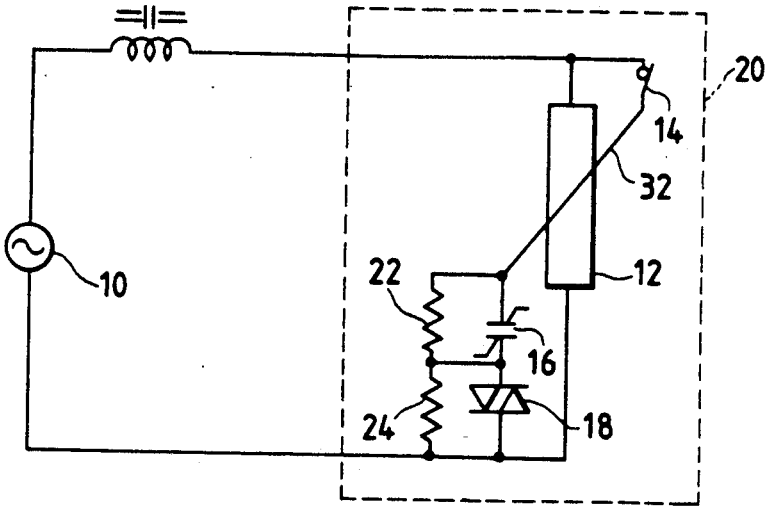

The above-described first and second embodiments (FIG. 7 and FIG. 11) may be modified as shown in FIGS. 13 and 14, respectively. That is, in each of the modifications, an external start assisting conductor 32 is connected between the thermal switch 14 and the FEC 16, so as to accelerate discharge in the arc tube 12 to positively start the discharge lamp.

Figure 15:
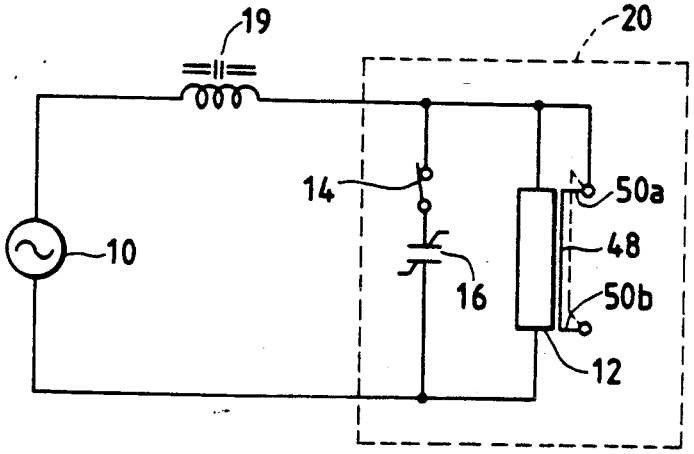
FIG. 15 is a circuit diagram showing a fourth example of the high-pressure metal vapor discharge lamp according to the invention.
Figure 16:
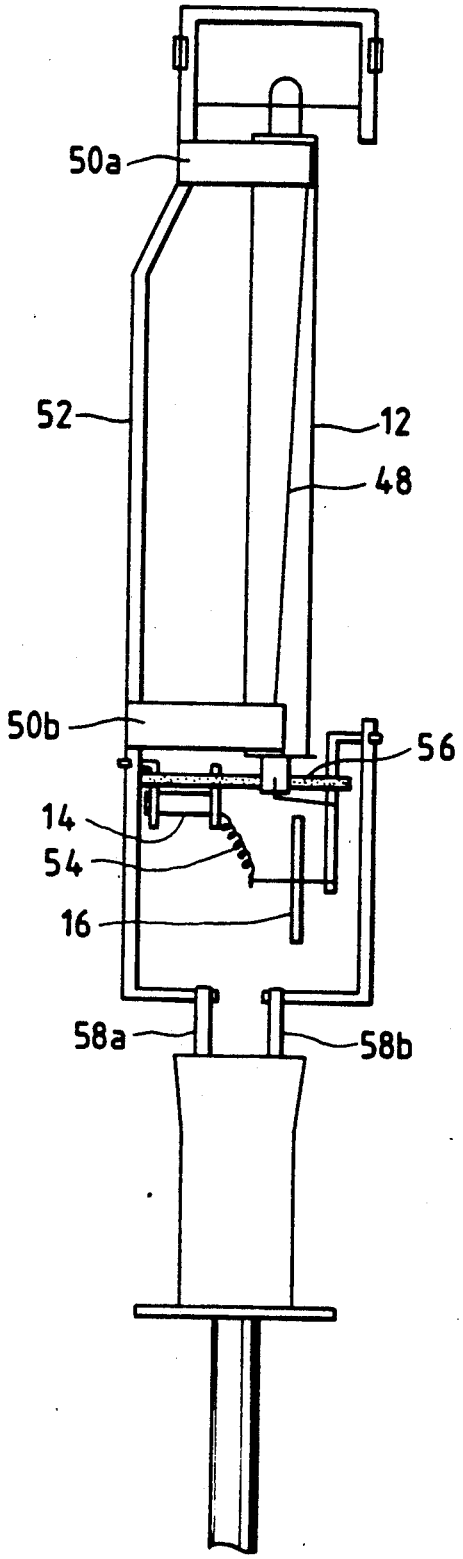
FIG. 16 is a diagram showing an arc tube and its relevant parts in the discharge lamp shown in FIG. 15.

FIG. 15 shows another example of the high-pressure metal vapor discharge lamp which constitutes a fourth embodiment of the invention. FIG. 16 shows an arc tube and its relevant parts in the discharge lamp.

As shown in FIGS. 15 and 16, thermally operating pieces 50*a* and 50*b* constituting a thermal switch are connected to both ends of a start assisting conductor 48. As shown best in FIG. 16, the other ends of the thermally operating pieces 50*a* and 50*b* are fixedly welded to a support 52. In the embodiment, the starter is an FEC 16 connected through a thermal switch 14 to a power source 10.

In FIG. 16, reference numeral 54 designates a tungsten coil serving as an overcurrent preventing fuse; 56, an insulating support on which a thermal switch 14 etc. are mounted; and 58*a* and 58*b*, lead wires connected through a lamp base to the power source. Furthermore, in the embodiment, an arc tube 12 may be a 110 W high-pressure sodium lamp.

In order to start the lamp in the circuit, it is essential for the FEC 16 to generate a suitable pulse voltage. As is seen from FIG. 17 indicating generated pulse voltages with temperatures of the FEC in the case where the lamp is operated with a 125 W mercury lamp ballast, the pulse voltages generated by the FEC 16 are acceptable when the temperature is about 65° C. or lower.

Figure 5:
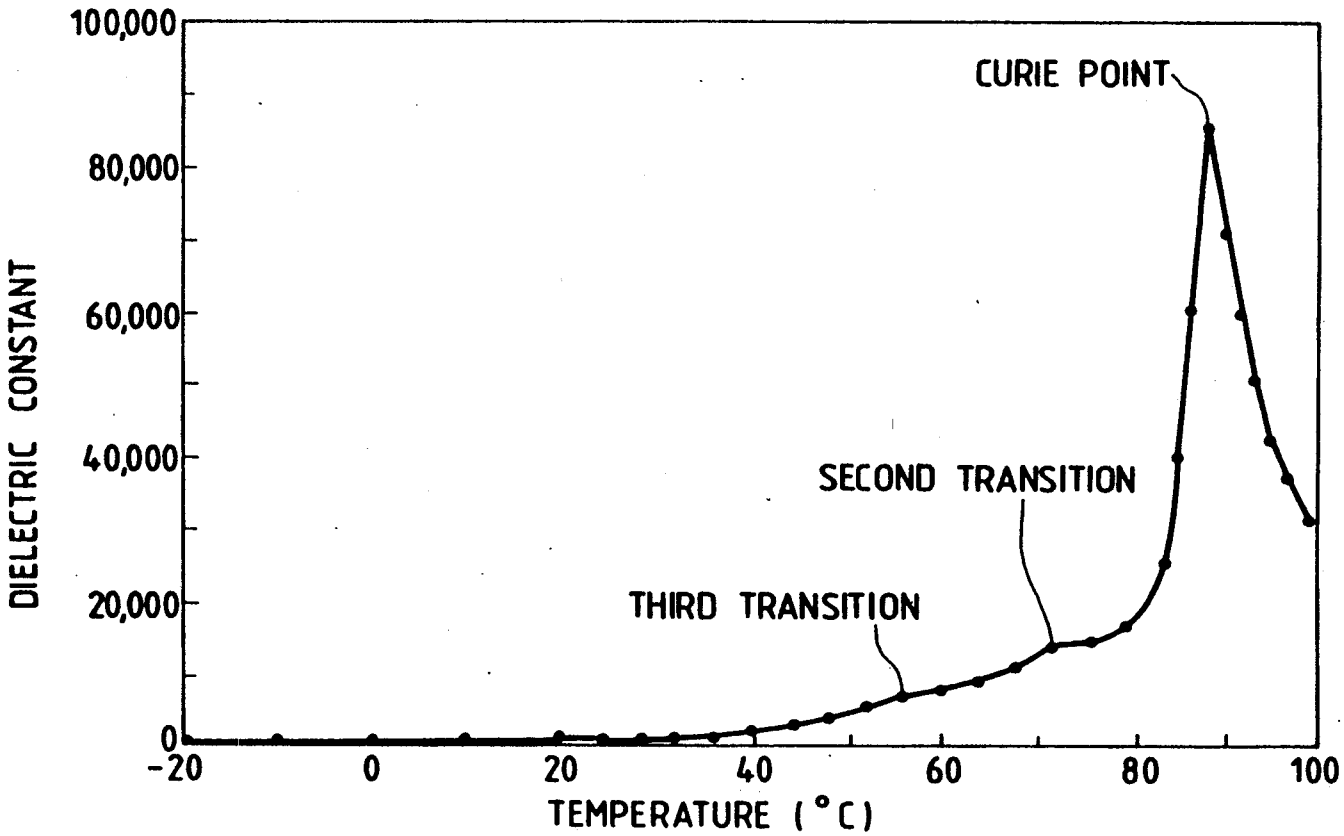
FIG. 5 is a graphical representation indicating the variation in dielectric constant of an FEC with temperature.
Figure 6:
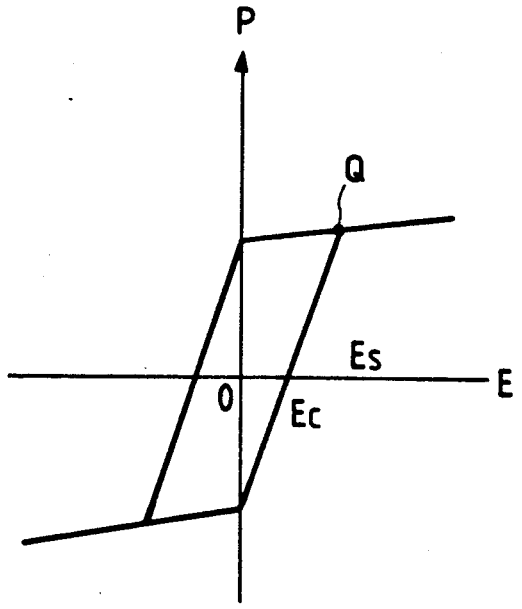
FIG. 6 is a graphical representation showing an ordinary poling - electric field hysteresis characteristic of the FEC.
Figure 18:
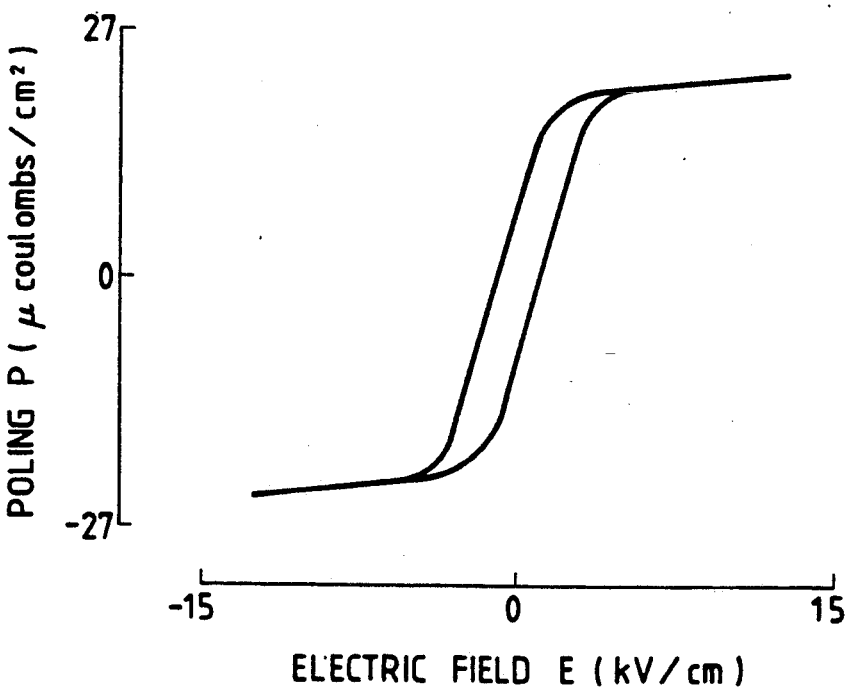
FIG. 18 is a graphical representation indicating the hysteresis characteristic of the FEC under particular conduction.

In order to start the lamp, the FEC 16 should show an excellent non-linear characteristic. According to FIG. 5 showing the variation in dielectric constant characteristic of the FEC with temperature, the ferro-electric region is below the Curie point (Tcp=90° C.), providing the non-linear characteristic. Especially below the third transition ($T_{3rd}$=55° C.), as shown in FIG. 18 the P (poling) - E (electric field) hysteresis characteristic is excellent; that is, current changes greatly with voltage. Thus, a high pulse voltage according to the following equation can be obtained:

$$Vp = -L\, di/dt$$

where L is inductance, i is current, and t is time.

Figure 17:
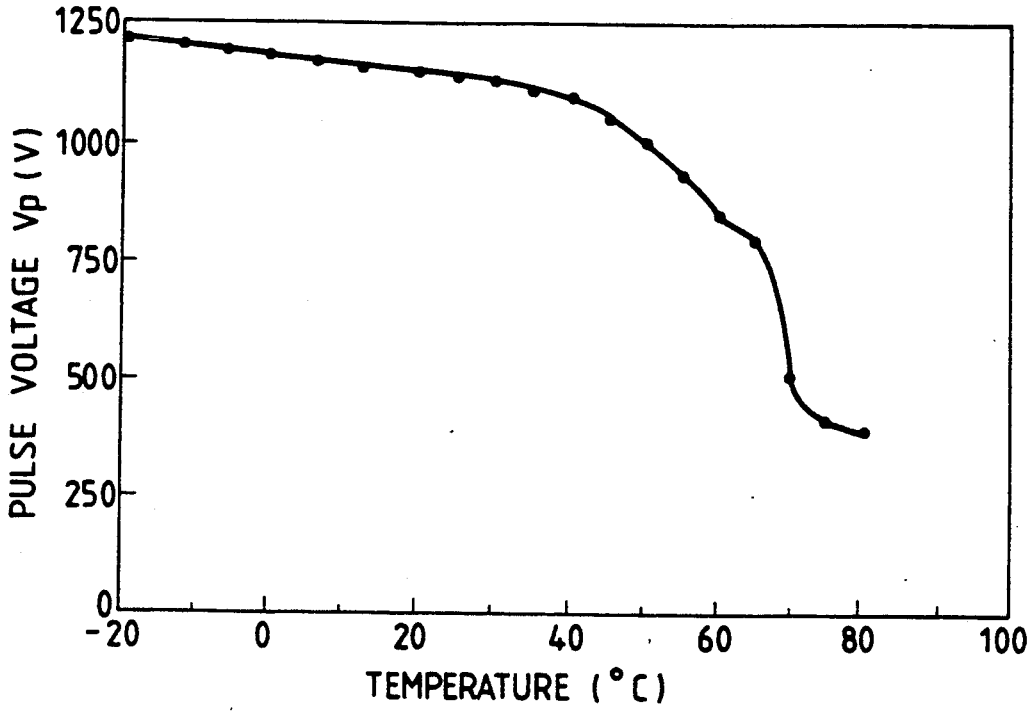
FIG. 17 is a graphical representation indicating generated pulse voltages with temperatures of the FEC in the case where the lamp is operated with a 125W mercury lamp ballast.

When this fact is taken into consideration together with FIG. 17 showing pulses voltages with temperatures, it can be said that it is practical to operate the FEC at 65° C. or lower. However, in the case where the generation of such a high pulse voltage is not required for lamp starting, the FEC may be operated at a temperature just lower than the Curie point of the FEC. In practice, the circuit described above is so designed that, when the FEC 16 is at a temperature lower than about 65° C., the thermal switch 14 is turned on.

The operation of the high-pressure metal vapor discharge lamp thus designed will be described.

In starting the lamp, the thermal switch 14 is in "on" state, so that high voltage is applied to the FEC 16, so that the latter 16 produces a pulse voltage to light up the lamp.

When the lamp is operated in this manner, then the thermal switch 14 is turned off, as a result of which the FEC 16 forming the starter is electrically disconnected from the power source 10. Furthermore, the thermally operating pieces 50*a* and 50*b* constituting a thermal switch are also operated to move the start assisting conductor 48 away from the wall of the arc tube 12 as indicated by the chain line in FIG. 15.

After the lamp has been turned off; that is, in starting the lamp again, the thermal switch is turned on as the temperature of the arc tube 12 decreases, so that the FEC 16 produces a pulse voltage.

It is desirable that, after the lamp has been lighted, the thermal switch 14 is turned off at a temperature lower than the Curie temperature of the FEC 16. That is, if the electric field is applied to the FEC 16 when the temperature is high than the Curie point, then the FEC is increased in the above-described loss (tan δ); that is, it is deteriorated, thus decreasing the generated pulse voltage. As is apparent from the above description, turning off the thermal switch 14 at a temperature lower than the Curie point of the FEC 16 results in the fact that, at restart, the thermal switch 14 is turned on at a temperature lower than the Curie point.

In starting the lamp again, it is necessary to bring the start assisting conductor 48 into close contact with the arc tube 12 before the FEC 16 starts generating a pulse voltage (or before the thermal switch 14 is turned on).

For this purpose, in the embodiment, the thermally operating pieces 50*a* and 50*b* connected to the start assisting conductor 48 is so designed as to bring the start assisting conductor 48 into contact with the arc tube 12 when the FEC 16 is cooled down to the Curie point.

The discharge lamp thus designed was operated with a 125 W mercury lamp ballast. About two minutes after the starting operation, the thermal switch 14 was turned off, and the start assisting conductor 48 was moved away from the arc tube 12.

After the lamp being operated for a sufficiently long period of time, the power source was turned off, and then immediately turned on. In about five minutes, the start assisting conductor 48 was brought into close contact with the arc tube 12. And in about twelve minutes, the thermal switch 14 was turned on. In this operation, the temperature of the FEC 16 was 65° lower than the Curie point, and therefore the FEC 16 generates a suitable pulse voltage, whereby the lamp is positively started again.

Figure 19:
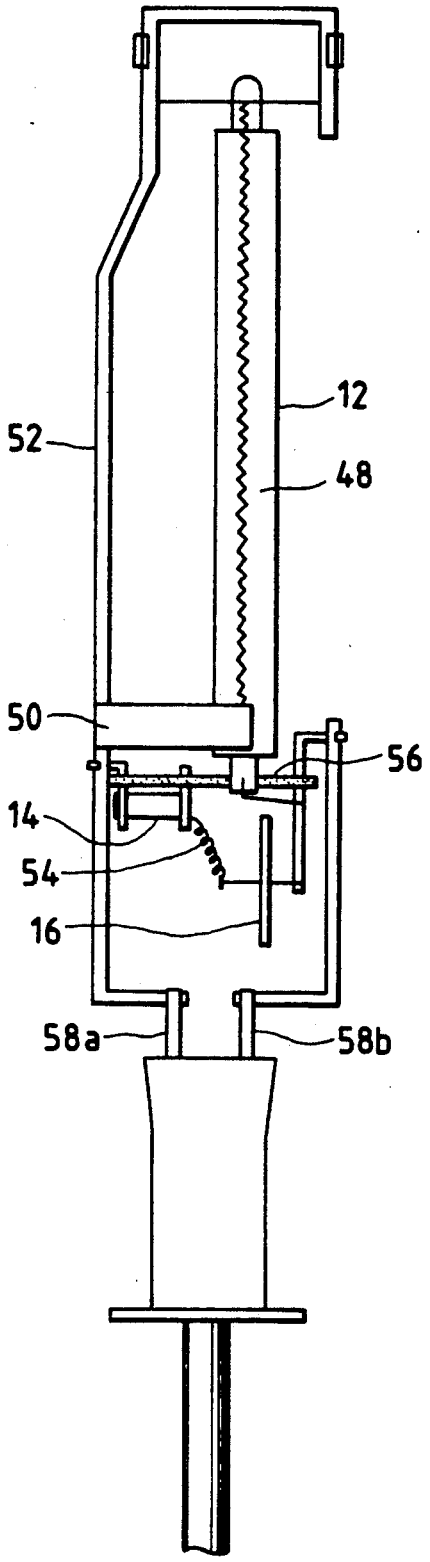
FIG. 19 is a diagram showing an arc tube and its relevant parts in a fifth example of the high-pressure metal vapor discharge lamp according to the invention.

Another example of the high-pressure metal vapor discharge lamp, a fifth embodiment of the invention, will be described with reference to FIG. 19.

The fifth embodiment is different from the fourth embodiment (FIG. 16) in that only one thermally operating piece 50 is provided at one end (near the bulb base) of the start assisting conductor 48 which is made up of a coil of refractory metal. The fifth embodiment is similar in function to the fourth embodiment described above.

Figure 20:
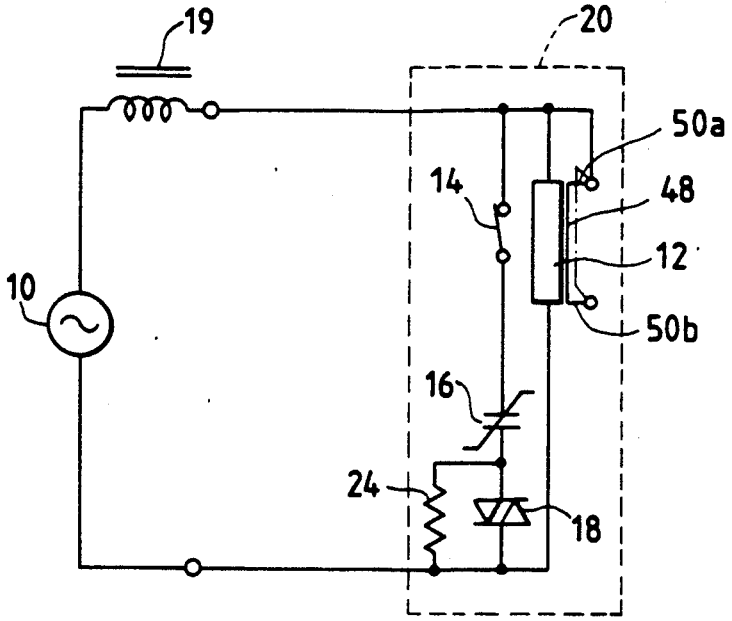
FIG. 20 is a circuit diagram showing a sixth example of the high-pressure metal vapor discharge lamp according to the invention.

FIG. 20 shows a sixth embodiment of the high-pressure metal vapor discharge lamp according to the invention. The discharge lamp, as shown in FIG. 20, comprises: a series circuit of a thermal switch 14, an FEC 16 and a semiconductor switch 18 built in the lamp base; a resistor 24 connected in parallel to the semiconductor switch 18; and an arc tube 12 which is a 400 W high-pressure sodium lamp. The resistor 24 is to stabilize the switching phase of the semiconductor switch.

The sixth embodiment thus designed is similar in effect to the fourth embodiment (FIGS. 15 and 16).

Figure 21:
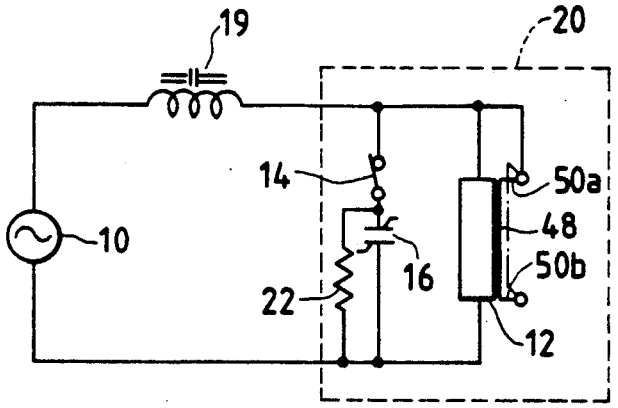
FIGS. 21 and 22 are circuit diagrams showing modifications of the fourth and sixth examples of the high-pressure metal vapor discharge lamp starting circuit according to the invention, respectively.
Figure 22:
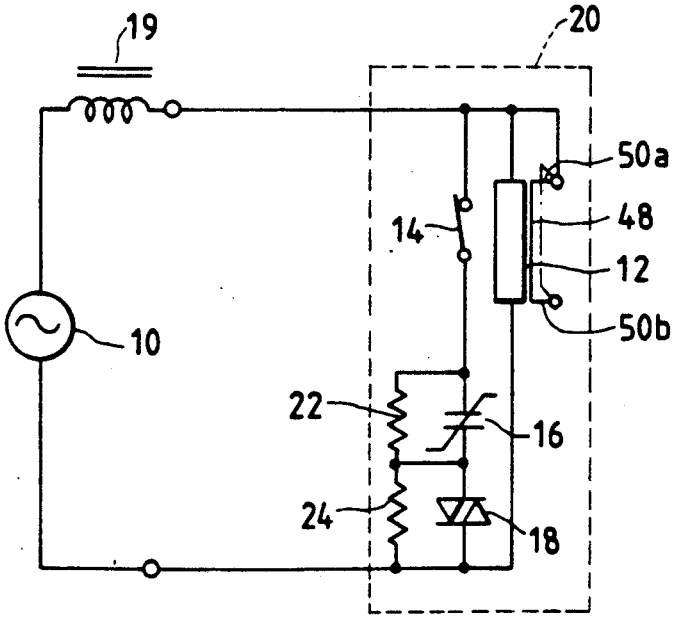

In the high-pressure metal vapor discharge lamp using a start assisting conductor according to the fourth to sixth embodiments of the invention, there is no provision of a pyroelectric current bypassing resistor connected in parallel to a non-linear ceramic capacitor, which is provided in the first to third embodiments. However, it is preferable to provide such a pyroelectric current bypassing resistor in the lamp using a start assisting conductor, as shown in FIGS. 21 and 22.

As was described above, in the high-pressure metal vapor discharge lamp of the invention, the pyroelectric current bypassing resistor is connected in parallel to the FEC, to bypass the pyroelectric current which is allowed to flow by depoling of the FEC after the lamp is turned on and the FEC is poled. Therefore, the deterioration of the P - E hysteresis characteristic of the FEC is prevented, and the FEC can provide a high pulse voltage stably, which lengthens the service life of the discharge lamp.

Furthermore, in the high-pressure metal vapor discharge lamp of the invention, while the lamp is operated the thermal operating piece positively sets the external start assisting piece away from the arc tube, which eliminates the difficulty that the wall of the arc tube is cracked or the sodium leaks from the arc tube.

In addition, the FEC operates at a temperature lower than the Curie point, and at restart the start assisting conductor is brought into close contact with the arc tube by the thermal operating piece before the thermal switch is turned on. Thus, either the lamp can be positively started under enough cooled condition or restarted after power is turned off for a few seconds.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A high-pressure metal vapor discharge lamp, comprising:

an arc tube which is connected to a power source;

lamp starting means including a series circuit of a first thermal switch and a non-linear ceramic capacitor, said series circuit being connected in parallel to said arc tube, and a pyroelectric current bypassing resistor connected in parallel to said non-linear ceramic capacitor; and a lamp outer bulb incorporating said arc tube and said lamp starting means.

2. A high-pressure metal vapor discharge lamp as claimed in claim 1, wherein said first thermal switch is kept closed at room temperature and opened when an ambient temperature increases to a predetermined value.

3. A high-pressure metal vapor discharge lamp as claimed in claim 1, wherein said first thermal switch changes state at a temperature lower than the Curie point of said non-linear ceramic capacitor.

4. A high-pressure metal vapor discharge lamp as claimed in claim 1, wherein said pyroelectric current bypassing resistor discharges energy which is charged in said non-linear ceramic capacitor immediately before said first thermal switch is opened.

5. A high-pressure metal vapor discharge lamp as claimed in claim 1, further comprising a start assisting conductor for applying electric field to the inside of said arc tube; and a second thermal switch for allowing said start assisting conductor to be brought into close contact with and moved away from said arc tube.

6. A high-pressure metal vapor discharge lamp as claimed in claim 5, wherein said second thermal switch operates to bring said start assisting conductor into close contact with said arc tube before said first thermal switch is turned on, in starting said lamp again.

7. A high-pressure metal vapor discharge lamp as claimed in claim 5, wherein said second thermal switch operates to move away said start assisting conductor from said arc tube after said first thermal switch is turned off in starting said lamp.

* * * * *